US009667017B2

(12) United States Patent
Suzuki et al.

(10) Patent No.: US 9,667,017 B2
(45) Date of Patent: May 30, 2017

(54) CONNECTOR AND MANUFACTURING METHOD THEREOF

(71) Applicant: YAZAKI CORPORATION, Tokyo (JP)

(72) Inventors: Shogo Suzuki, Shizuoka (JP); Masayuki Saitoh, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/139,571

(22) Filed: Apr. 27, 2016

(65) Prior Publication Data

US 2016/0322727 A1 Nov. 3, 2016

(30) Foreign Application Priority Data

Apr. 30, 2015 (JP) ..... 2015-093013

(51) Int. Cl.

| | |
|---|---|
| ***H01R 43/24*** | (2006.01) |
| ***H01R 13/504*** | (2006.01) |
| ***H01R 11/01*** | (2006.01) |
| ***H01R 11/09*** | (2006.01) |
| ***H01R 13/405*** | (2006.01) |
| *H01R 13/05* | (2006.01) |
| *H01R 13/50* | (2006.01) |
| *H01R 11/12* | (2006.01) |

(52) U.S. Cl.

CPC ..... *H01R 43/24* (2013.01); *H01R 11/01* (2013.01); *H01R 11/09* (2013.01); *H01R 13/405* (2013.01); *H01R 13/504* (2013.01); *H01R 11/12* (2013.01); *H01R 13/055* (2013.01); *H01R 13/50* (2013.01)

(58) Field of Classification Search

CPC ..... H01R 43/24

See application file for complete search history.

(56) References Cited

U.S. PATENT DOCUMENTS 4,547,964 A * 10/1985 Amano ..... H01R 43/205 174/541
4,595,805 A * 6/1986 Masuda ..... H01H 11/00 200/51 R
4,602,830 A * 7/1986 Lockard ..... H01R 24/22 439/108
6,083,051 A * 7/2000 Chang ..... H01R 12/716 439/660
6,302,736 B1 * 10/2001 Nishio ..... H01R 13/504 439/404

(Continued)

FOREIGN PATENT DOCUMENTS

JP 2005-174697 A 6/2005
JP 2013-82256 A 5/2013

(Continued)

*Primary Examiner* — James Harvey
(74) *Attorney, Agent, or Firm* — Kenealy Vaidya LLP

(57) ABSTRACT

A connector includes: a connecting member including a plurality of tab sections and made of a conductive metal material; and a housing which is made of resin and in which the connecting member is insert-molded. Terminals of a counterpart connector are connectable to the tab sections by a connection of the counterpart connector. A part of the connecting member is used as a connection member holding section gripped by a mold. The connection member holding section is exposed to an outside at an opening section formed in the housing.

6 Claims, 10 Drawing Sheets

(56) References Cited

U.S. PATENT DOCUMENTS 7,824,225 B1 * 11/2010 Wang ..... H01R 13/2442 439/630
8,025,538 B2 * 9/2011 Hara ..... H01R 4/64 439/723
8,100,730 B2 * 1/2012 Hara ..... H01R 4/64 439/721
8,137,116 B2 * 3/2012 Omori ..... H01R 4/64 439/883
2001/0006854 A1 * 7/2001 Moriwake ..... H01R 43/16 439/78
2004/0047118 A1 * 3/2004 Bergmann ..... H01L 31/02013 361/728
2007/0167047 A1 * 7/2007 Ohashi ..... B29C 45/0025 439/164
2013/0288540 A1 * 10/2013 Cheng ..... H01R 24/76 439/688
2014/0220792 A1 * 8/2014 Omori ..... H01R 4/64 439/34
2014/0235090 A1 * 8/2014 Omori ..... H01R 4/64 439/350
2015/0180163 A1 * 6/2015 Saitoh ..... H01R 13/506 439/701
2015/0214662 A1 * 7/2015 Muro ..... H01R 13/73 439/345
2015/0268261 A1 * 9/2015 Murray, Jr. ..... H01R 13/6683 73/493
2015/0357771 A1 * 12/2015 Chen ..... H01R 24/70 439/607.01
2016/0064852 A1 * 3/2016 Saitoh ..... H01R 4/18 439/626
2016/0064887 A1 * 3/2016 Ishikawa ..... H01H 85/044 264/138
2016/0099522 A1 * 4/2016 Suzuki ..... H01R 4/64 439/101
2016/0156125 A1 * 6/2016 Osada ..... H01R 13/5216 439/587
2016/0322719 A1 * 11/2016 Saitoh ..... H01R 43/24
2016/0322727 A1 * 11/2016 Suzuki ..... H01R 11/01

FOREIGN PATENT DOCUMENTS

JP 2013-105659 A 5/2013
JP 2014-89811 A 5/2014

* cited by examiner

CONNECTOR AND MANUFACTURING METHOD THEREOF

CROSS REFERENCE TO RELATED APPLICATION(S)

This application is based on and claims priority from Japanese Patent Application (Application No. 2015-093013) filed on Apr. 30, 2015, the entire contents of which are incorporated herein by reference.

BACKGROUND

1. Field of the Invention

One or more embodiments of the present invention relate to a connector provided with an integrated connecting member and to a manufacturing method thereof.

2. Description of the Related Art

As a joint connector for connecting a plurality of electric wires collectively to the grounding portion of a vehicle, a connector is available in which a connecting member, such as a conductive plate, having a plurality of terminal sections to which electric wire side terminals are connected, is integrated with the housing of the connector (for example, refer to JP-A-2013-082256, JP-A-2013-105659, and JP-A-2014-089811).

This kind of connector equipped with a connecting member is manufactured by injecting molten resin into a mold in a state in which the connecting member is set inside the mold so that the connecting member is integrally molded with the resin (for example, refer to JP-A-2005-174697).

SUMMARY

However, in the case of insert-molding in which the connecting member is set inside the mold and the molten resin is injected into the mold so that the connecting member is integrally molded with the resin, the connecting member is required to be held at a predetermined position in the mold. Hence, when the insert-molding is performed, portions of the connecting member are gripped by the mold on the outside of the molding area of the housing, and the connecting member becomes large in size for the gripping, whereby the connector eventually becomes large in size.

One or more embodiments of the present invention are made in consideration of the above-mentioned circumstances, and an object thereof is to provide a connector capable of being made small in size and a manufacturing method thereof.

The above-described object of the one or more embodiments of the present invention can be achieved by the following configuration.

(1) A connector including: a connecting member including a plurality of tab sections and made of a conductive metal material; and a housing which is made of resin and in which the connecting member is insert-molded, wherein terminals of a counterpart connector are connectable to the tab sections by a connection of the counterpart connector, wherein a part of the connecting member is used as a connection member holding section gripped by a mold, and wherein the connection member holding section is exposed to an outside at an opening section formed in the housing.

(2) The connector described in the above-mentioned item (1), wherein the connecting member includes: a fastening plate section formed into a flat plate shape; and a supporting plate section which is raised from an end section of the fastening plate section, and a portion of which is embedded in the housing, wherein the tab sections are formed so as to continue to the supporting plate section, and wherein the portion of the supporting plate section is used as the connection member holding section.

(3) A manufacturing method of a connector, the connector including: a connecting member including a plurality of tab sections and made of a conductive metal material; and a housing which is made of resin and in which the connecting member is insert-molded, wherein terminals of the counterpart connector are connectable to the tab sections by a connection of the counterpart connector, said manufacturing method comprising: molding the housing by charging molten resin into the mold in a state in which the connecting member at a portion of a molding area of the housing is gripped by a mold for molding the housing.

In the connector configured as described in the above-mentioned item (1), the portions of the connecting member are used as the connection member holding sections that are gripped by the molds, and the connection member holding sections are exposed to the outside at the opening sections formed in the housing. Hence, when the housing is molded, the molding is performed while the connection member holding sections are gripped by the molds and the connecting member is held by the molds, whereby the connecting member can be made small in size in comparison with the connecting member that is used in the case that the housing is molded while the portions of the connecting member are gripped by the mold on the outside of the molding area of the housing and the connecting member is held inside the mold. Consequently, the entire connector can be made small in size, and the cost of the connector can be reduced by the reduction of materials caused by the downsizing of the connecting member.

In the connector configured as described in the above-mentioned item (2), the connection member holding sections of the connecting member can be gripped by the molds, whereby the length of the supporting plate section can be made short in comparison with the case in which the portions of the connecting member on the outside of the molding area of the housing are gripped by the molds. Hence, the height dimension of the connector from the fastening plate section to the upper section of the housing can be decreased.

With the manufacturing method of the connector configured as described in the above-mentioned item (3), in a state in which the connecting member at portions of the molding area of the housing is gripped by the molds for molding the housing, the molten resin is charged into the molds to mold the housing. Hence, a connecting member being small in size can be used in comparison with the case in which the housing is molded while the portions of the connecting member are gripped by the mold on the outside of the molding area of the housing and the connecting member is held inside the mold. Consequently, the entire connector can be made small in size, and the cost of the connector can be reduced by the reduction of materials caused by the downsizing of the connecting member.

One or more embodiments of the present invention can provide a connector capable of being made small in size and a manufacturing method thereof.

One or more embodiments of the present invention has been described above briefly. The details of the present invention will be further clarified by reading the descriptions of the mode (hereafter referred to as "embodiment") for embodying the invention to be described below referring to the accompanying drawings.

BRIEF DESCRIPTION OF THE DRAWINGS

FIG. 4A is a perspective view seen from the tip end side of the connector, and FIG. 4B is a perspective view seen from the rear end side thereof;

FIG. 5A is a front view, and FIG. 5B is a rear view;

FIG. 6A is a sectional view taken on line A-A of FIG. 5A, and FIG. 6B is a sectional view taken on line B-B of FIG. 5A;

FIG. 7A is a perspective view seen from the tip end side thereof, 7B is a perspective view seen from the rear end side thereof, and FIG. 7C is a rear view;

FIG. 10A is a front view showing the connector, and FIG. 10B is a schematic sectional view showing the molds.

DETAILED DESCRIPTION

Figure 1:
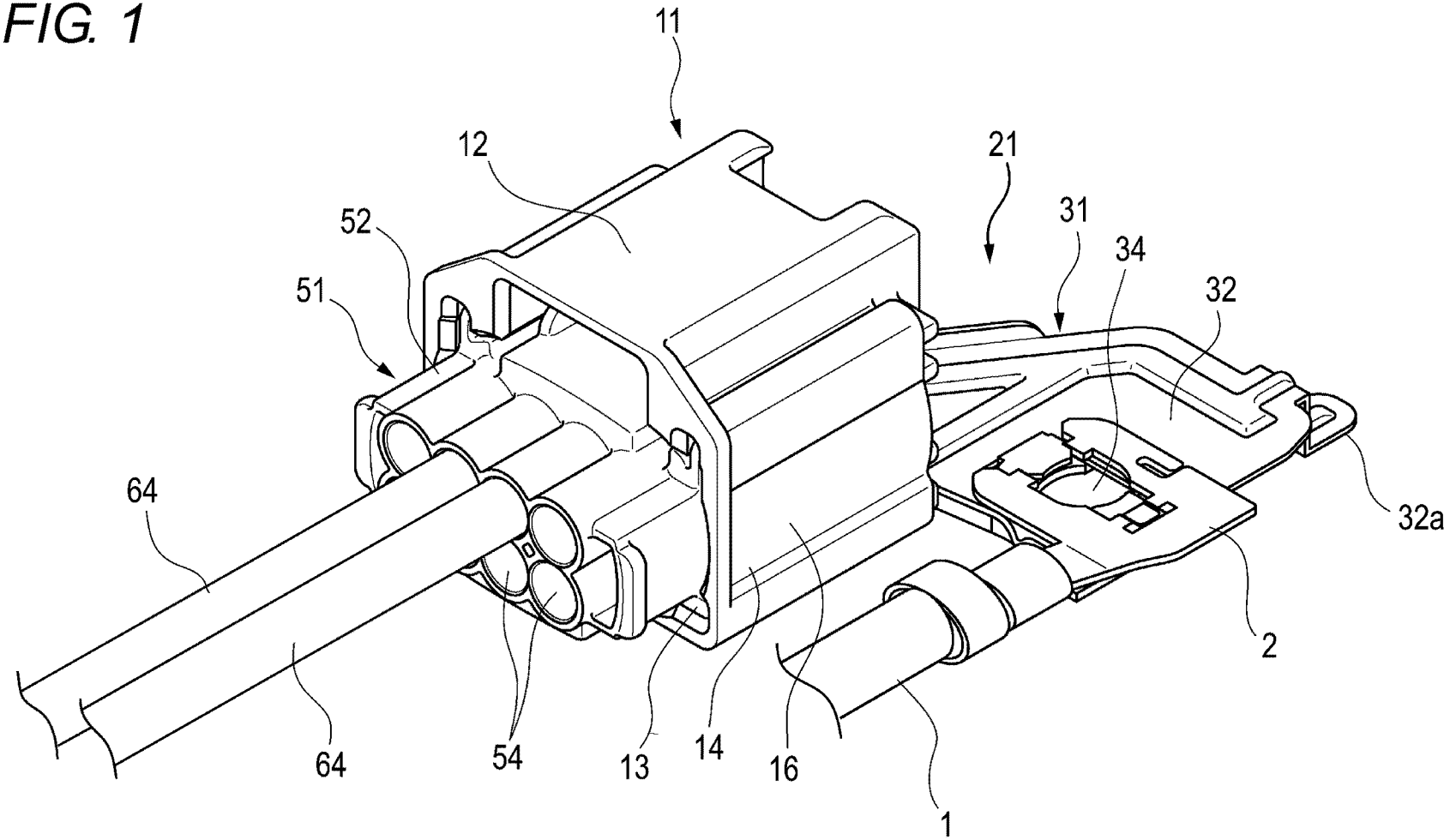
FIG. 1 is a perspective view showing a connector according to an embodiment to which a counterpart connector is connected.

An embodiment according to the present invention will be described below referring to the drawings.

Figure 2:
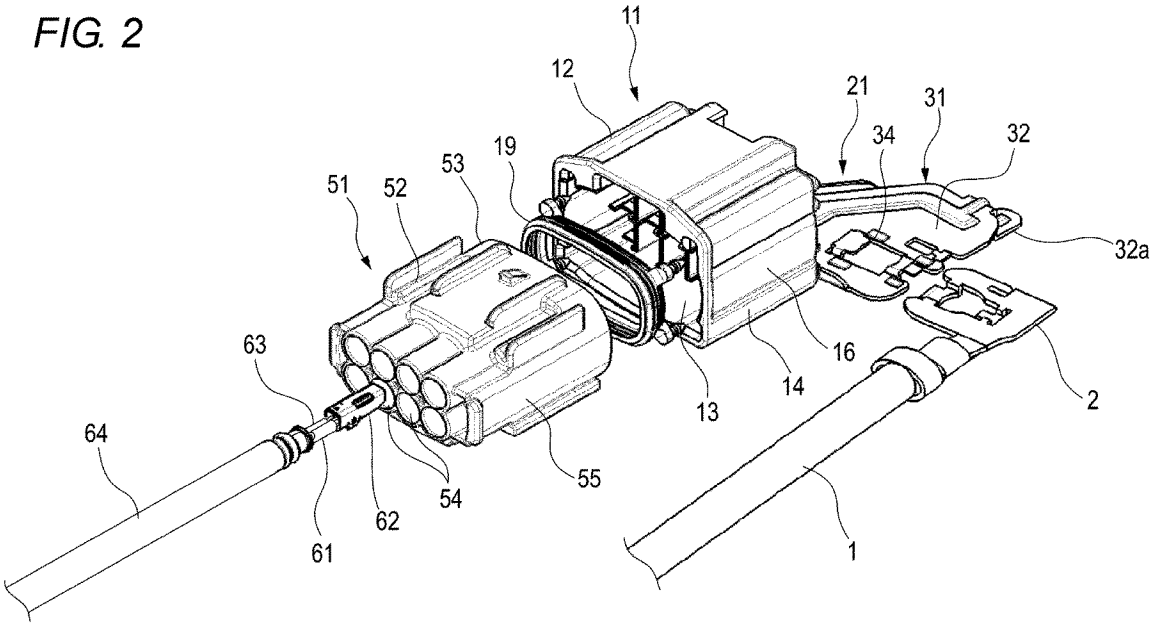
FIG. 2 is an exploded perspective view showing the connector according to the embodiment and the counterpart connector.

FIG. 1 is a perspective view showing a connector according to an embodiment to which a counterpart connector is connected. FIG. 2 is an exploded perspective view showing the connector according to the embodiment and the counterpart connector.

As shown in FIGS. 1 and 2, a counterpart connector 51 is connected to a connector 11 according to the embodiment.

The connector 11 is equipped with a male housing (housing) 12 made of resin, and the counterpart connector 51 is equipped with a female housing 52 made of resin.

A fitting concave section 13 being open on the tip end side of the male housing 12, that is, on the front side thereof in the direction of connection to the counterpart connector 51, is formed in the male housing 12, and the tip end side of the female housing 52, that is, the front side thereof in the direction of connection to the connector 11, is used as a fitting section 53. Furthermore, the fitting section 53 of the female housing 52 is fitted into the fitting concave section 13 of the male housing 12, whereby the counterpart connector 51 is connected to the connector 11.

Figure 3:
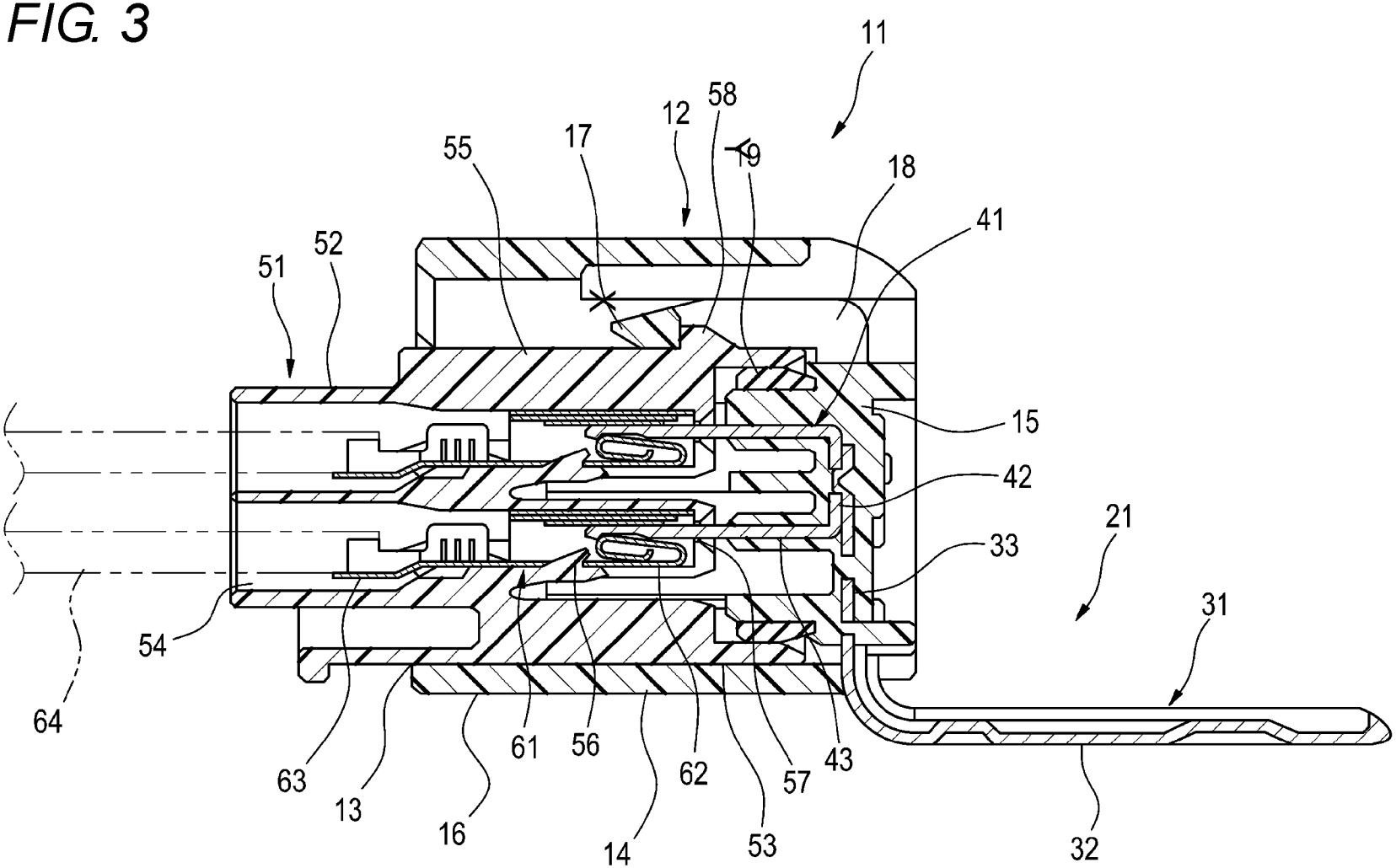
FIG. 3 is a sectional view showing a state in which the counterpart connector is connected to the connector according to the embodiment.

FIG. 3 is a sectional view showing a state in which the counterpart connector is connected to the connector according to the embodiment.

As shown in FIG. 3, the female housing 52 of the counterpart connector 51 has a housing body 55 in which a plurality of terminal housing chambers 54 are formed, and the tip end side of the housing body 55 is used as the fitting section 53. These terminal housing chambers 54 are formed along the direction of connection to the connector 11. The terminal housing chambers 54 are arranged in the width direction of the housing body 55 and further arranged in two stages in the vertical direction. Each terminal housing chamber 54 has a lance section 56 protruding from the lower side. Each terminal housing chamber 54 has an opening section 57 on the tip end side of the housing body 55. Furthermore, in the female housing 52, an engaging claw 58 is formed on the upper face of the housing body 55.

A female terminal (terminal) 61 is housed in the terminal housing chamber 54 from the rear end side thereof, that is, from the rear side thereof in the connection direction. The female terminal 61 is, for example, made of a conductive metal material, such as copper or copper alloy, and has an electrical connection section 62 and a crimping section 63. An electric wire 64 having a conductor covered with an outer coat is crimped at the crimping section 63, thereby being conducted and connected thereto. The female terminal 61 is inserted into the terminal housing chamber 54 from the rear end side of the housing body 55, whereby the electrical connection section 62 is engaged with the lance section 56. As a result, the female terminal 61 is held in a state of being housed in the terminal housing chambers 54.

Figure 4A:
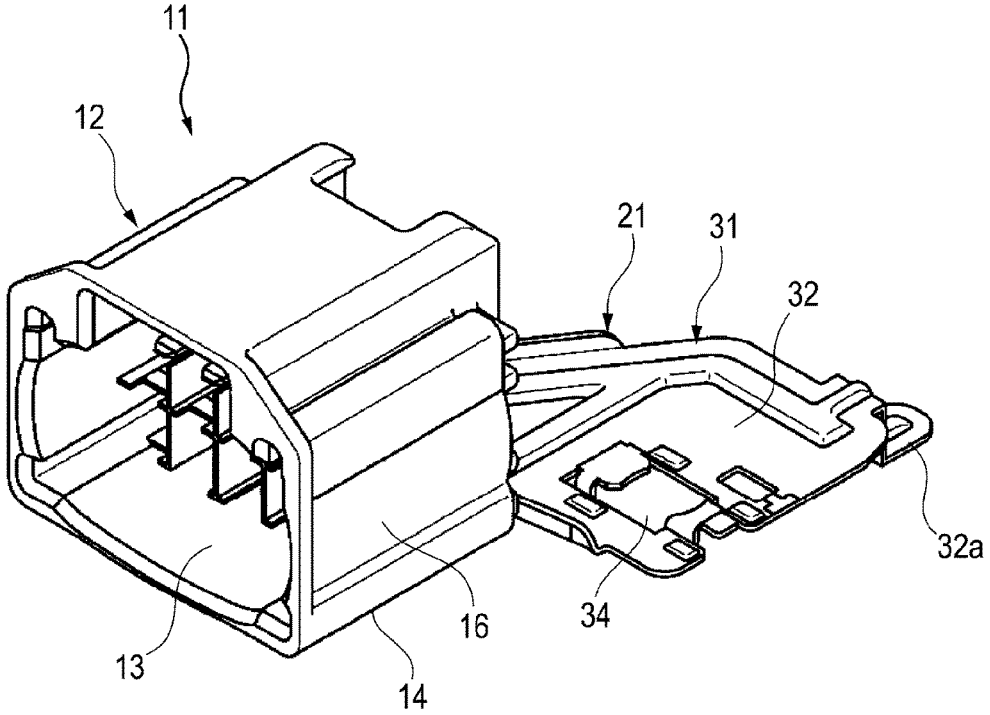
FIGS. 4A and 4B are views showing the connector according to the embodiment.
Figure 4B:
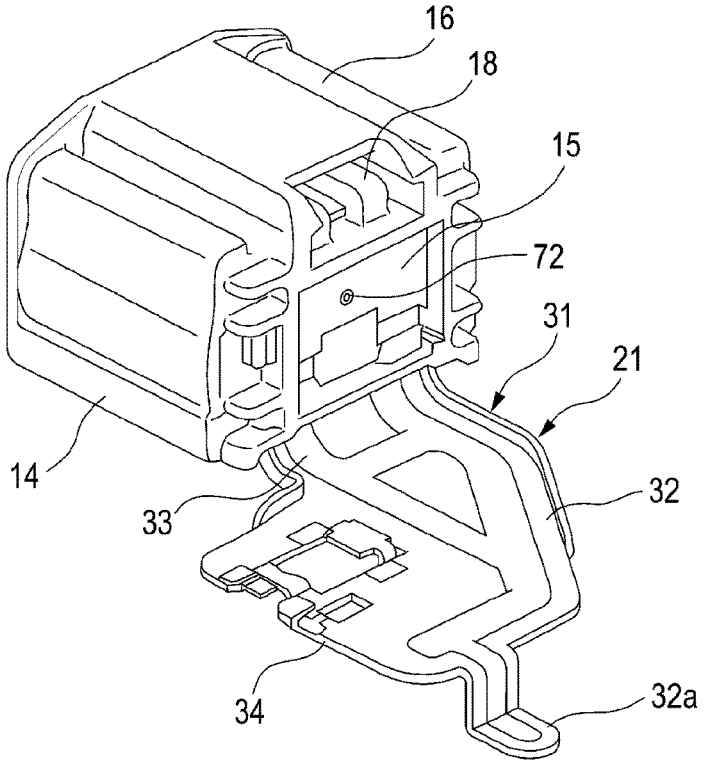
Figure 5A:
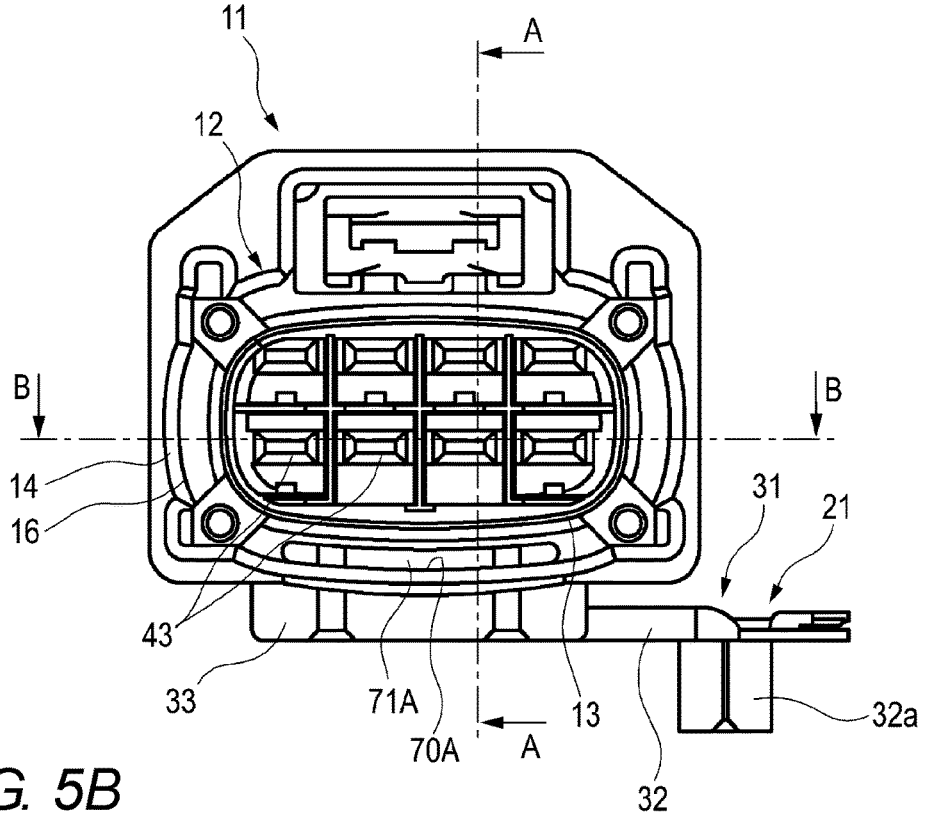
FIGS. 5A and 5B are views showing the connector according to the embodiment.
Figure 5B:
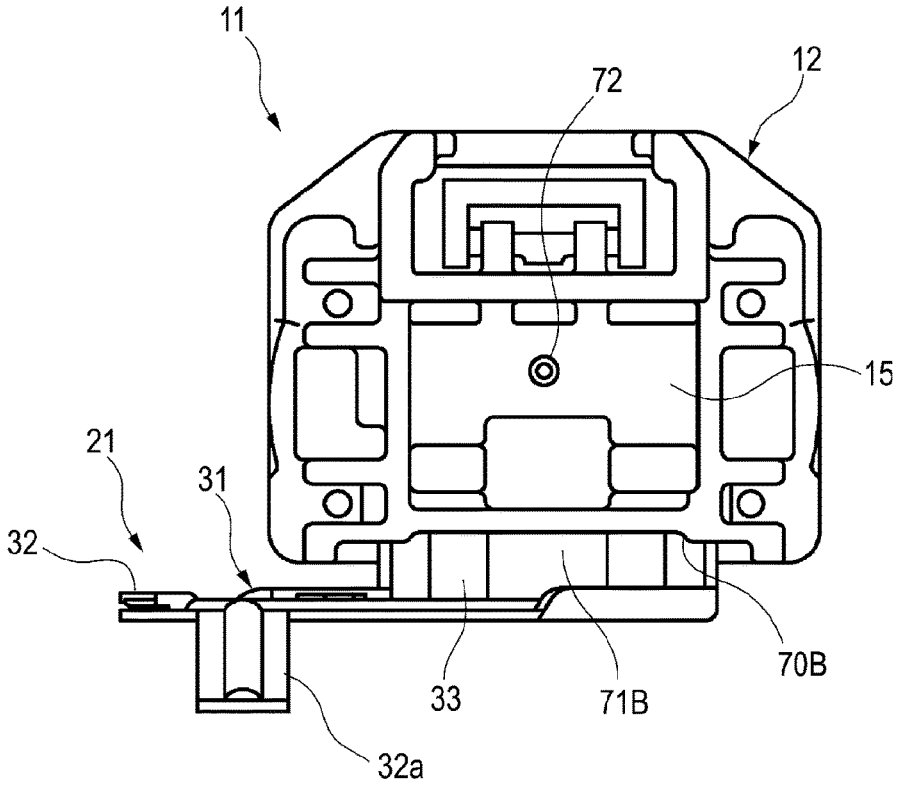
Figure 6A:
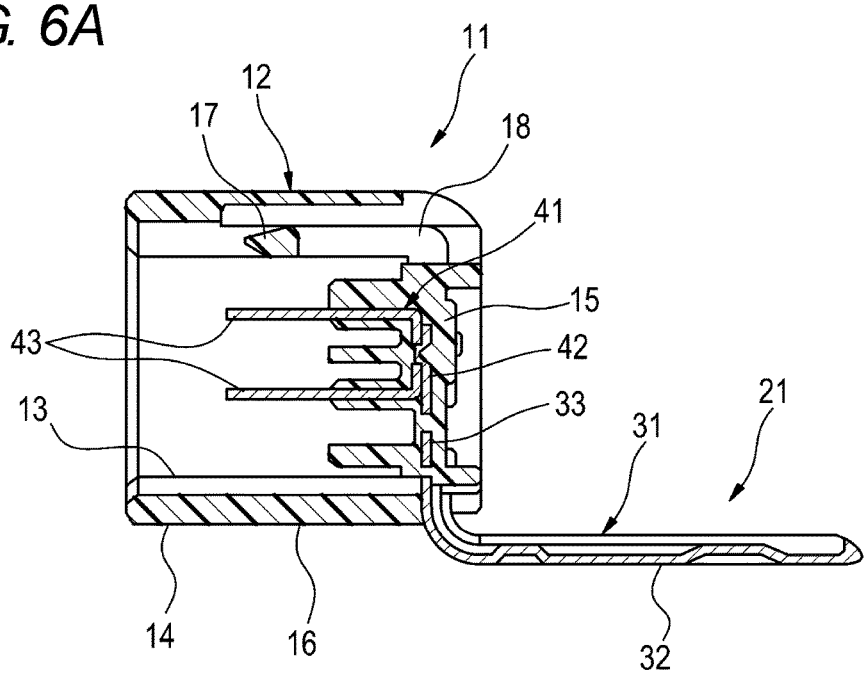
FIGS. 6A and 6B are views showing the connector according to the embodiment.
Figure 6B:
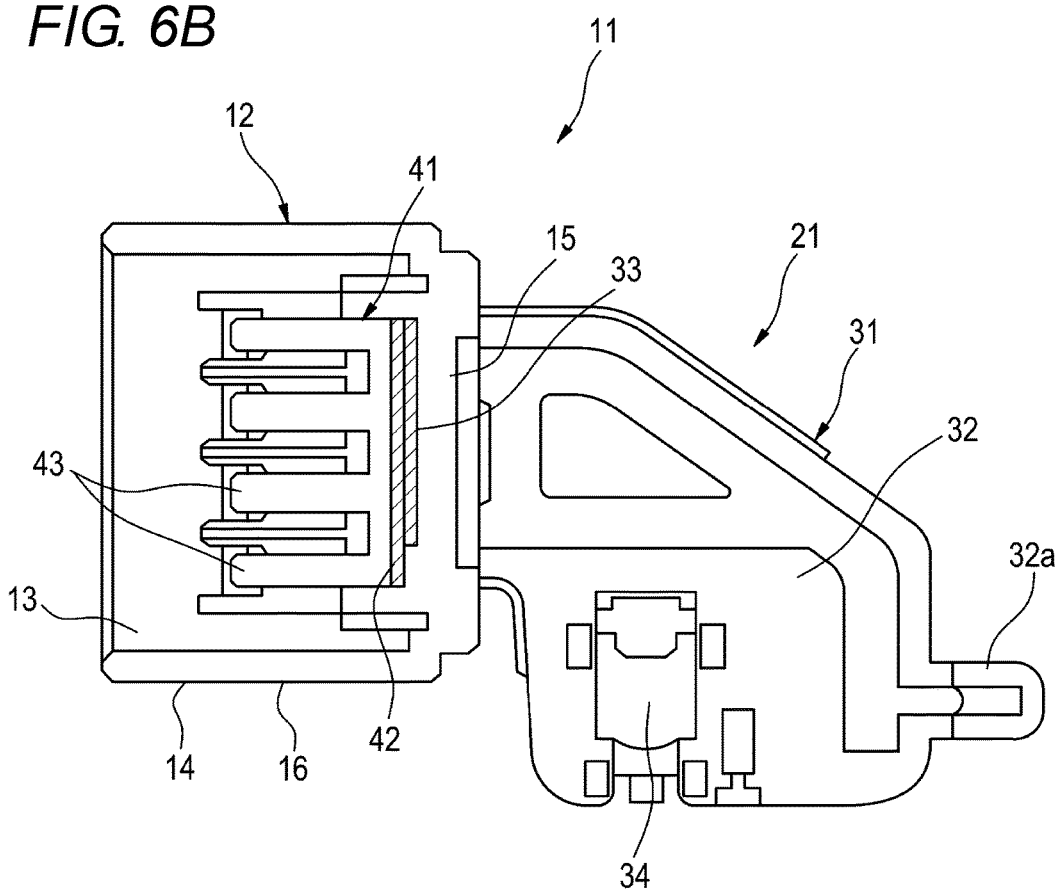

FIGS. 4A and 4B are views showing the connector according to the embodiment; FIG. 4A is a perspective view seen from the tip end side of the connector, and FIG. 4B is a perspective view seen from the rear end side thereof. FIGS. 5A and 5B are views showing the connector according to the embodiment; FIG. 5A is a front view, and FIG. 5B is a rear view. FIGS. 6A and 6B are views showing the connector according to the embodiment; FIG. 6A is a sectional view taken on line A-A of FIG. 5A, and FIG. 6B is a sectional view taken on line B-B of FIG. 5A.

The connector 11 has the male housing 12 and a connecting member 21 as shown in FIGS. 4A and 4B, FIGS. 5A and 5B, and FIGS. 6A and 6B.

The male housing 12 has a hood section 14, and the inside of this hood section 14 is used as the fitting concave section 13. The hood section 14 has a bottom wall 15 and a peripheral wall 16 extending from the peripheral edges of this bottom wall 15 to the tip end side. Furthermore, in the male housing 12, a locking arm 18 is formed in the upper section inside the fitting concave section 13. In this locking arm 18, the engaging claw 58 of the female housing 52 fitted in the fitting concave section 13 is engaged with the engaging section 17, whereby the connection state of the female housing 52 to the male housing 12 is maintained. Moreover, in the male housing 12, a packing 19 formed into a ring shape is fitted inside the hood section 14 (see FIGS. 2 and 3). When the fitting section 53 of the female housing 52 is fitted in the fitting concave section 13 of the male housing 12, this packing 19 is used to stop water from penetrating between the fitting concave section 13 and the fitting section 53.

Figure 7A:
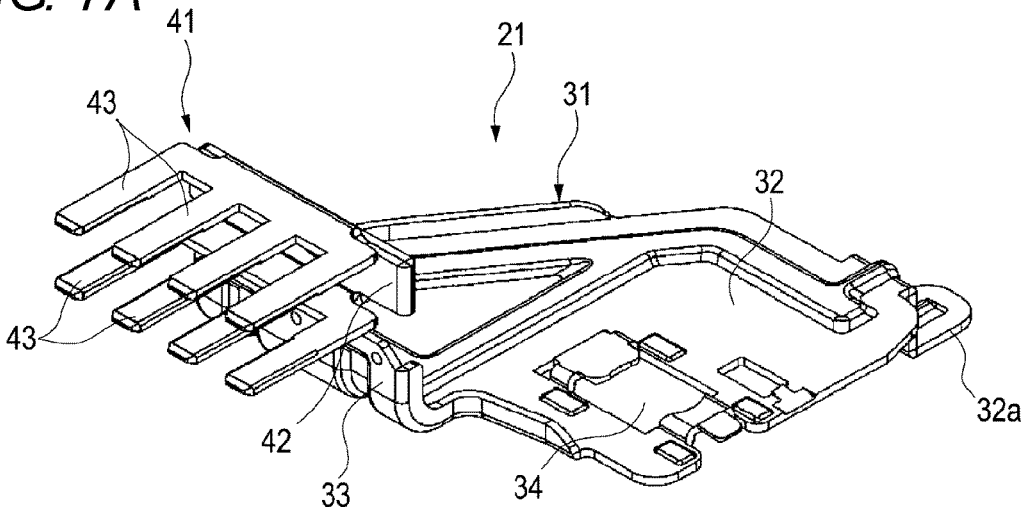
FIGS. 7A to 7C are views showing a connecting member constituting the connector according to the embodiment.
Figure 7B:
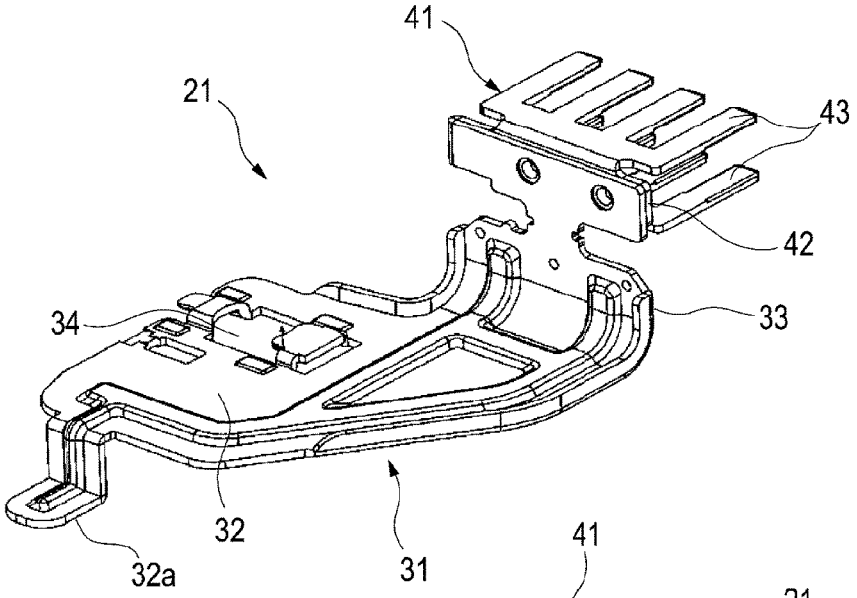
Figure 7C:
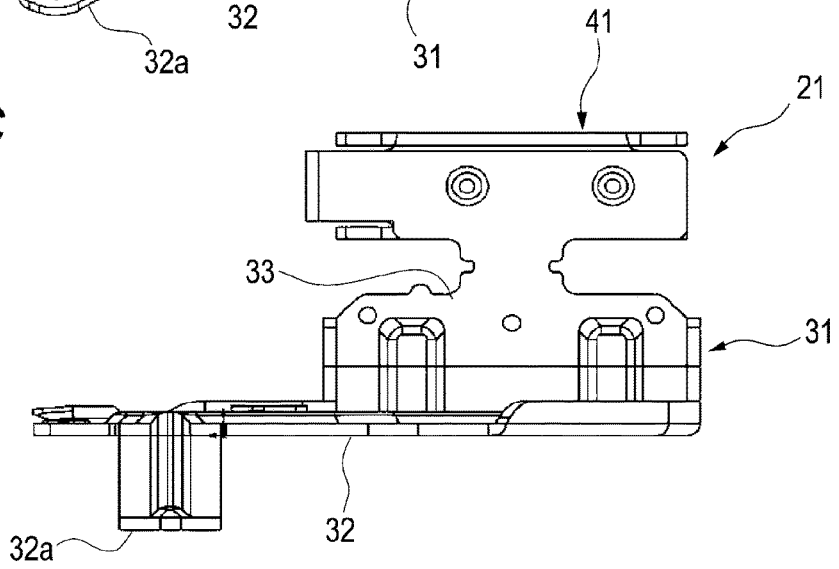

FIGS. 7A to 7C are views showing the connecting member constituting the connector according to the embodiment; FIG. 7A is a perspective view seen from the tip end side thereof, 7B is a perspective view seen from the rear end side thereof, and FIG. 7C is a rear view.

As shown in FIGS. 7A to 7C, the connecting member 21 includes a bus bar 31 and a terminal fitting 41. The bus bar 31 and the terminal fitting 41 are, for example, made of a conductive metal material, such as copper or copper alloy, and integrally formed by press work.

The bus bar 31 has a fastening plate section 32 having a flat plate shape and a supporting plate section 33 rising from this fastening plate section 32. A bolt insertion hole 34 is formed in the fastening plate section 32. A bolt (not shown) inserted into the bolt insertion hole 34 is fastened to the body of a vehicle, whereby the fastening plate section 32 is fastened and fixed to the body, whereby the bus bar 31 is grounded. The grounding terminal 2 of a grounding wire 1 is fastened together with the fastening plate section 32 using the bolt (see FIG. 1). A rotation-stopping piece 32*a* is formed at a portion of the fastening plate section 32. The rotation-stopping piece 32*a* is a bent section to be engaged with a stepped section or a hole section provided around a grounding face to which the fastening plate section 32 is fastened with the bolt, and the rotation-stopping piece 32*a* is engaged with the stepped section or the hole section provided around the grounding face, whereby the rotation of the fastening plate section 32 with respect to the grounding face is restricted.

The terminal fitting 41 has a base section 42 and a plurality of tab sections 43. The base section 42 is formed into a flat plate shape, and the tab sections 43 protrude from the edge section of the base section 42 in the same direction. Furthermore, in the connecting member 21, the plurality of tab sections 43 protruding in a direction orthogonal to the face of the supporting plate section 33 are arranged in two stages in the vertical direction.

As shown in FIGS. 6A and 6B, the connecting member 21 is insert-molded in the male housing 12. Hence, the connecting member 21 is integrated with the male housing 12 in a state in which the supporting plate section 33 and the terminal fitting 41 of the bus bar 31 are embedded in the bottom wall 15 for forming the fitting concave section 13 of the male housing 12. Furthermore, the tab sections 43 of the connecting member 21 protrude from the bottom wall 15 into the fitting concave section 13.

As shown in FIGS. 5A and 5B, the connector 11 has opening sections 70A and 70B in the male housing 12. The resin for forming the male housing 12 does not exist in these opening sections 70A and 70B, and portions of the supporting plate section 33 at the bus bar 31 of the connecting member 21 are exposed. The exposed portions, that is, the portions of the supporting plate section 33 of the connecting member 21, are used as connection member holding sections 71A and 71B that are gripped by molds to be used for insert molding. The opening section 70B on the rear end side of the male housing 12 is formed into a concave shape in which the lower side is opened.

Moreover, as shown in FIGS. 4B and 5B, in the connector 11, the side of the connecting member 21 of the male housing 12 on the opposite side in the protruding direction of the tab sections 43 is used as a resin charging gate section 72, and resin for molding the male housing 12 is charged from this resin charging gate section 72.

Next, a case in which the counterpart connector 51 is connected to the connector 11 will be described below.

The tip end of the female housing 52 of the counterpart connector 51 is directed to and brought close to the tip end of the male housing 12 of the connector 11 in order that the counterpart connector 51 is connected to the connector 11. Then, the fitting section 53 of the housing body 55 of the female housing 52 is inserted into the fitting section 53 of the hood section 14 of the male housing 12.

Hence, the tab sections 43 formed at the terminal fitting 41 of the connecting member 21 of the male housing 12 are inserted from the opening section 57 on the tip end side of the housing body 55 of the female housing 52 into the electrical connection sections 62 of the female terminals 61 and held therein, whereby the connecting member 21 is conductively connected to the female terminals 61, and the electric wires 64 are conducted to the connecting member 21. In addition, the respective electric wires 64 are mutually conducted via the connecting member 21. Furthermore, in this state, the engaging section 17 of the locking arm 18 is engaged with the engaging claw 58, whereby the female housing 52 and the male housing 12 are locked in a state of being connected.

In the case that the counterpart connector 51 is removed from the connector 11 that has been connected to the counterpart connector 51 as described above, a jig is used to release the engagement of the engaging section 17 of the locking arm 18 with the engaging claw 58.

In this state, the counterpart connector 51 is pulled apart from the connector 11. Hence, the fitting section 53 of the female housing 52 is extracted from the fitting concave section 13 of the hood section 14 of the male housing 12. As a result, the tab sections 43 of the connecting member 21 are extracted from the electrical connection sections 62 of the female terminals 61, and the conductive connection between the female terminals 61 and the connecting member 21 is released.

Next, a case will be described in which the connector 11 integrated with the connecting member 21 by insert-molding is manufactured.

Figure 8:
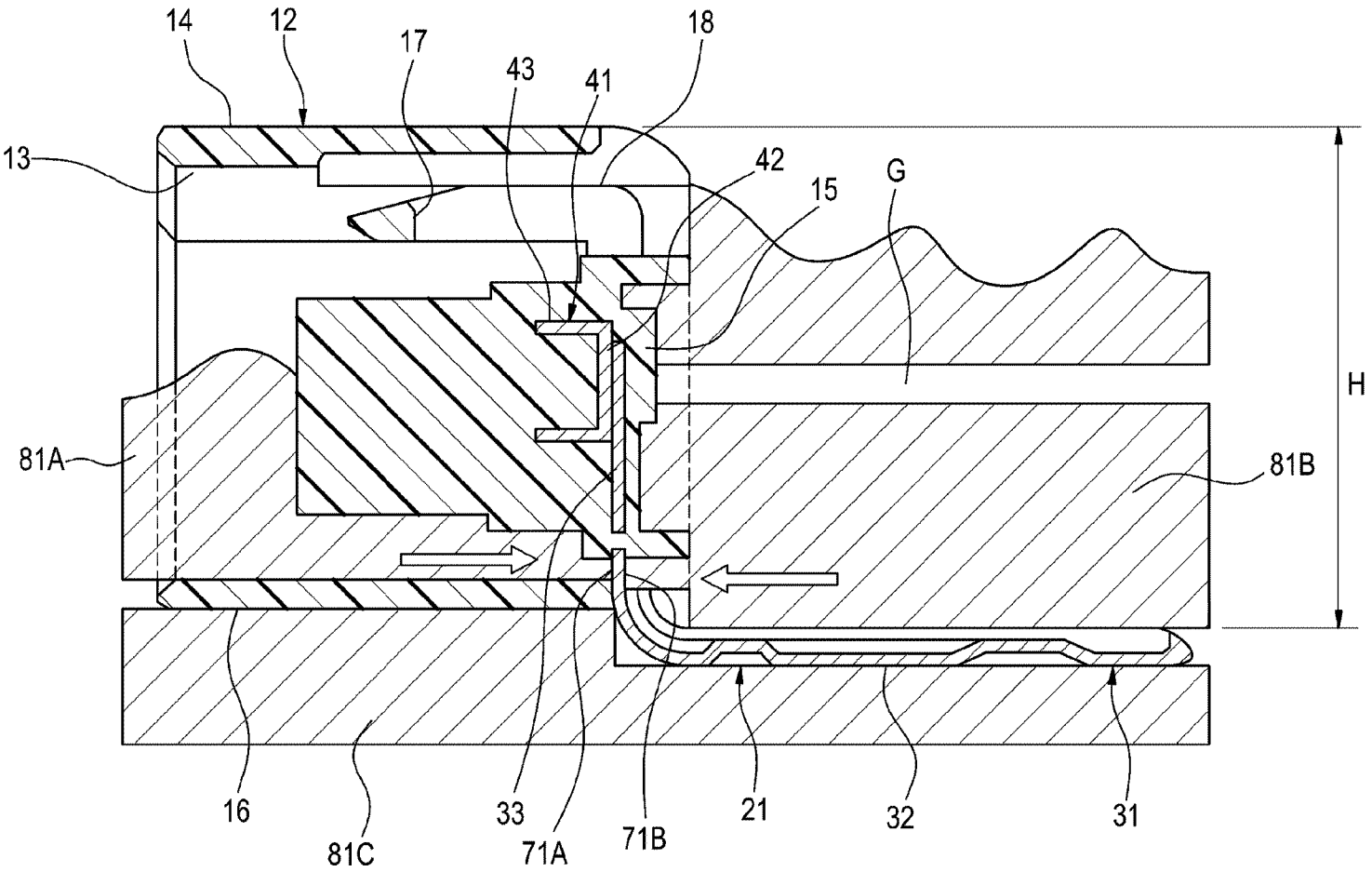
FIG. 8 is a schematic sectional view showing molds and explaining a manufacturing method of the connector according to the embodiment.
Figure 9:
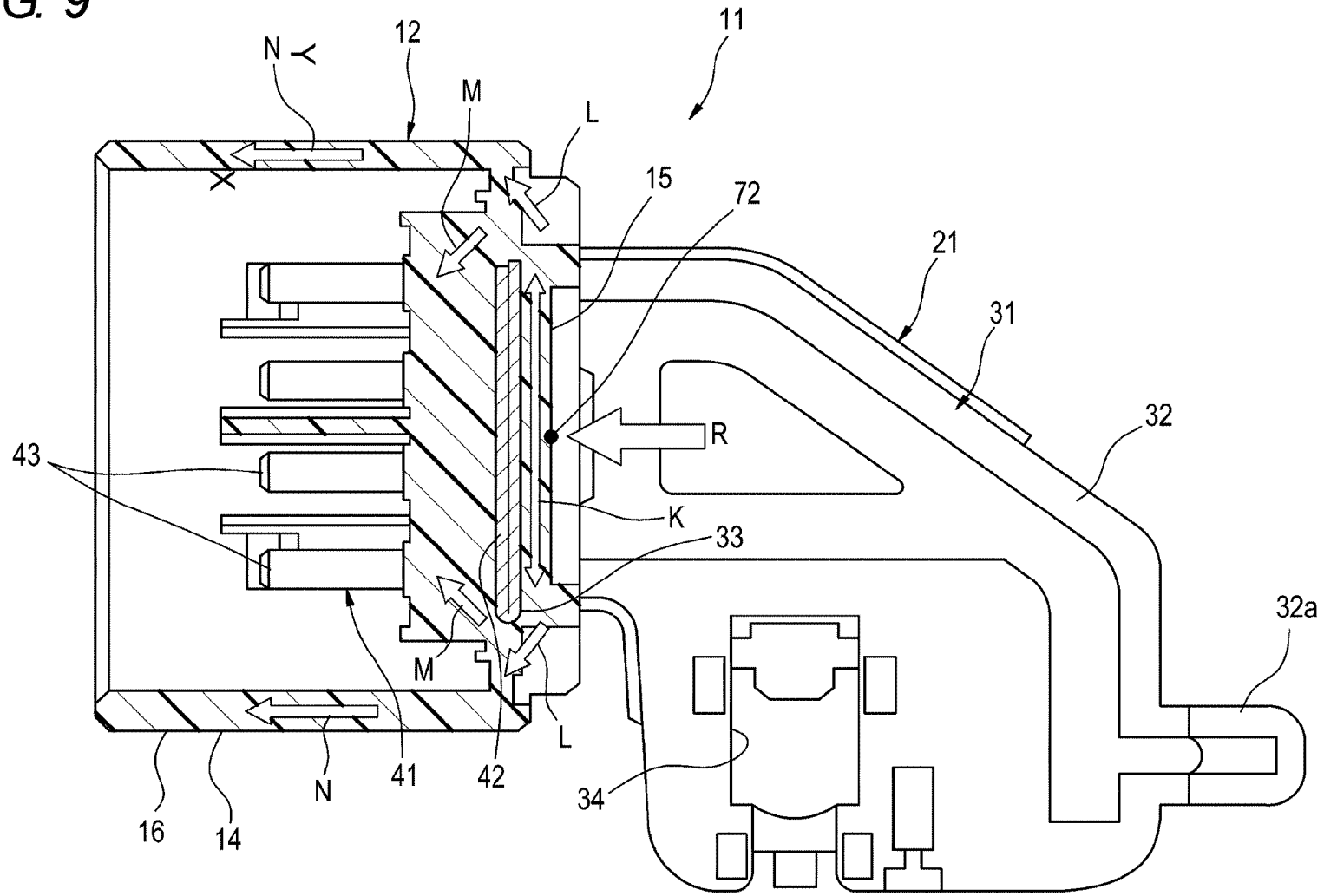
FIG. 9 is a horizontal sectional view showing the connector and indicating the flow of resin.

FIG. 8 is a schematic sectional view showing molds and explaining a manufacturing method of the connector according to the embodiment. FIG. 9 is a horizontal sectional view showing the connector and indicating the flow of resin.

As shown in FIG. 8, molds 81A, 81B and 81C are used to mold the male housing 12 by insert-molding and to manufacture the connector 11. The mold 81A is a forming mold on the front side of the male housing 12, the mold 81B is a forming mold on the rear side of the male housing 12, and the mold 81C is a forming mold on the lower face side of the male housing 12. The mold 81A on the front side of the male housing 12 and the mold 81C on the lower face side thereof are integrated. When these molds 81A, 81B and 81C are used for insert-molding, the connection member holding sections 71A and 71B, that is, the portions of the molding area of the male housing 12, are gripped and supported by the molds 81A and 81C and the mold 81B. In this state, molten resin is injected from the gate G provided on the mold 81B. The gate G is provided at the position on the face of the terminal fitting 41 of the connecting member 21 on the opposite side in the protruding direction of the tab sections 43.

As shown in FIG. 9, when the molten resin is injected from the gate G of the mold 81B (indicated by arrow R in FIG. 9), the resin hits the face of the terminal fitting 41 of the connecting member 21 on the opposite side in the protruding direction of the tab sections 43, and then the resin is spread into the resin injection space formed by the molds 81A, 81B and 81C. More specifically, the resin flows in the vertical direction and the left-right direction on the face of the terminal fitting 41 of the connecting member 21 on the opposite side in the protruding direction of the tab sections 43 (indicated by arrows K and L in FIG. 9), goes around to the side of the terminal fitting 41 of the connecting member 21 on the side in the protruding direction of the tab sections 43 (indicated by arrow M in FIG. 9), and flows into the molding space of the hood section 14 (indicated by arrow N in FIG. 9).

Then, after the curing of the resin having being charged into the resin injection space inside the molds 81A, 81B and 81C, the integrated molds 81A and 81C are extracted to the front side of the male housing 12, and the connector 11 is removed from the molds 81A, 81B and 81C. As a result, the connector 11 integrated with the connecting member 21 by insert-molding is obtained.

As described above, with the embodiment, the portions of the supporting plate section 33 of the connecting member 21 are used as connection member holding sections 71A and 71B that are gripped by the molds 81A and 81C and the mold 81B, and the connection member holding sections 71A and 71B are exposed to the outside at the opening sections 70A and 70B formed in the male housing 12. Hence, at the time of the molding of the male housing 12, the male housing 12 can be molded in a state in which the connection member holding sections 71A and 71B are gripped by the molds 81A and 81B inside the molding area of the male housing 12 and the connecting member 21 is held by the molds 81A and 81C and the mold 81B.

A reference example will herein be described below.

Figure 10A:
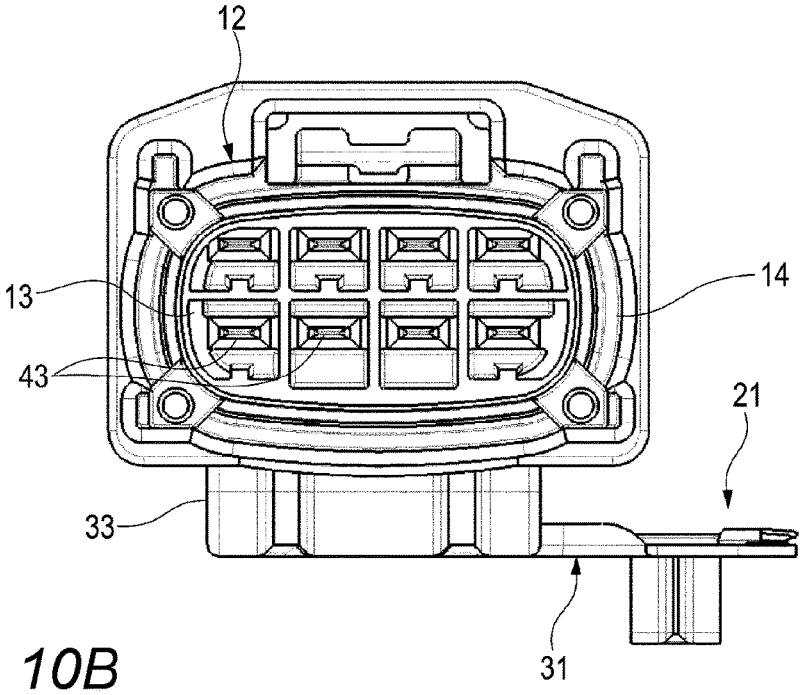
FIGS. 10A and 10B are views explaining a connector according to a reference example is molded.
Figure 10B:
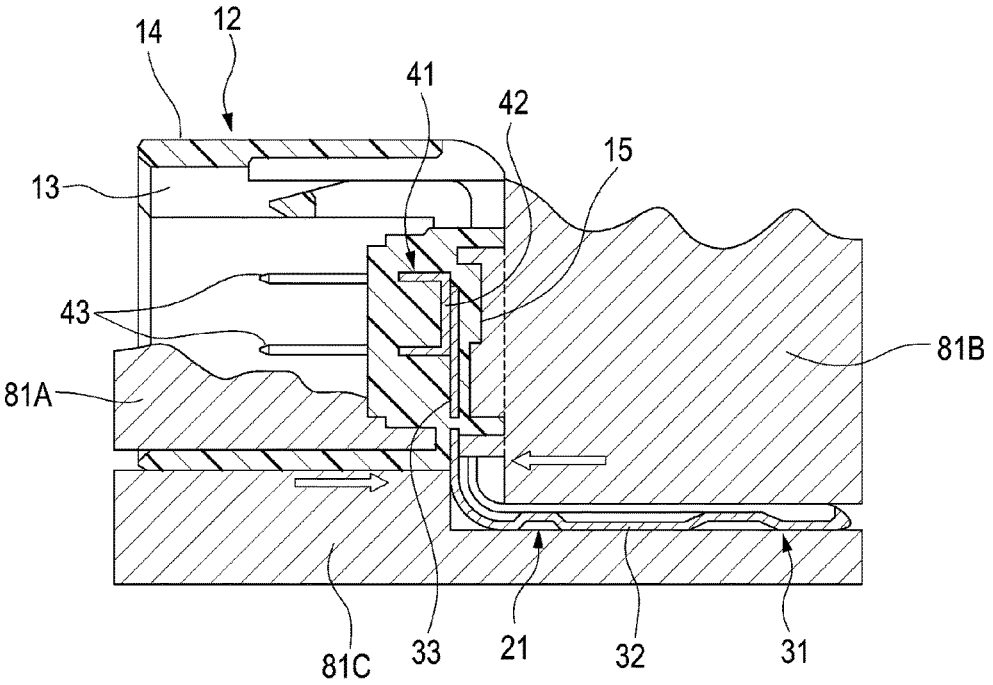

FIGS. 10A and 10B are views illustrating a connector according to a reference example; FIG. 10A is a front view showing the connector, and FIG. 10B is a schematic sectional view showing the molds for the connector.

As shown in FIG. 10A, in the reference example, the male housing 12 is not provided with the connection member holding sections 71A and 71B. In the case of the structure in which the male housing 12 is not provided with the connection member holding sections 71A and 71B as described above, at the time of the molding of the male housing 12, the connecting member 21 is required to be gripped by the molds 81C and 81B outside the molding area of the male housing 12 as shown in FIG. 10B. Hence, the connecting member 21 is required to be securely provided with grip portions that are gripped by the molds 81C and 81B outside the molding area of the male housing 12, whereby the connecting member 21 is enlarged in size, and this causes an enlargement in the size of the connector 11.

On the other hand, with the embodiment, at the time of the molding of the male housing 12, the male housing 12 can be molded in a state in which the connection member holding sections 71A and 71B provided at portions of the molding area of the male housing 12 are gripped by the molds 81A and 81C and the mold 81B and the connecting member 21 is held by the molds 81A and 81C and the mold 81B, whereby the connecting member 21 can be made small in size. More specifically, the length of the supporting plate section 33 of the connecting member 21 can be made short. Hence, the height dimension H of the connector 11 from the fastening plate section 32 to the upper section of the male housing 12 can be decreased (see FIG. 8). Consequently, the connector 11 can be made small in size, and the cost of the connector 11 can be reduced by the reduction of materials caused by the downsizing of the connecting member 21.

However, the present invention is not limited to the above-mentioned embodiment, but can be modified or improved as necessary. In addition, the materials, shapes, dimensions, quantities, arrangement positions, etc. of the respective components in the above-mentioned embodiment may be arbitrary and not limited, provided that the present invention can be achieved.

The characteristics of the connector and the manufacturing method thereof according to the embodiment of the present invention described above will be briefly summarized and listed in the following items [1] to [3].

[1] A connector (11) including: a connecting member (21) including a plurality of tab sections (43) and made of a conductive metal material; and a housing (12) which is made of resin and in which the connecting member (21) is insert-molded, wherein terminals (61) of a counterpart connector (51) are connected to the tab sections (43) by a connection of the counterpart connector (51), wherein a part of the connecting member (21) is used as a connection member holding section (71A, 71B) gripped by a mold (81A, 81B, 81C), and wherein the connection member holding section (71A and 71B) is exposed to an outside at an opening section (70A, 70B) formed in the housing (12).

[2] The connector (11) described in the above-mentioned item [1], wherein the connecting member (21) includes: a fastening plate section (32) formed into a flat plate shape; and a supporting plate section (33) which is raised from an end section of the fastening plate section (32), and a portion of which is embedded in the housing (12), wherein the tab sections (43) are formed so as to continue to the supporting plate section (33), and wherein the portion of the supporting plate section (33) is used as the connection member holding section (71A, 71B).

[3] A manufacturing method of a connector (11), the connector (11) including: a connecting member (21) including a plurality of tab sections (43) and made of a conductive metal material; and a housing (12) which is made of resin and in which the connecting member (21) is insert-molded, wherein terminals (61) of the counterpart connector (51) are connected to the tab sections (43) by a connection of the counterpart connector (51), said manufacturing method comprising: molding the housing (12) by charging molten resin into the mold (81A, 81B, 81C) in a state in which the connecting member (21) at a portion of a molding area of the housing (12) is gripped by a mold (81A, 81B, 81C) for molding the housing (12).

What is claimed is:

1. A connector comprising:

a connecting member comprising a plurality of tab sections and made of a conductive metal material; and a housing which is made of resin and in which the connecting member is insert-molded, wherein terminals of a counterpart connector are connectable to the tab sections by a connection of the counterpart connector, wherein the connecting member includes a connection member holding section that is configured to be gripped by a mold, and wherein the housing includes an opening that is in communication with the connection member holding section such that the connection member holding section is exposed to an outside of the housing.

2. The connector according to claim 1, wherein the connecting member comprises:

a fastening plate section formed into a flat plate shape; and a supporting plate section which is raised from an end section of the fastening plate section, and a portion of which is embedded in the housing, wherein the tab sections are formed so as to continue to the supporting plate section, and wherein the portion of the supporting plate section is used as the connection member holding section.

3. A manufacturing method of a connector comprising:

providing a connecting member including a plurality of tab sections and made of a conductive metal material, wherein terminals of a counterpart connector are connectable to the tab sections by a connection of the counterpart connector, and the connecting member further including a molding area configured to be insert-molded in a housing;

gripping a portion of the molding area by a mold; and molding the housing onto the molding area by charging molten resin into the mold in a state in which the portion of the molding area is gripped by the mold.

4. The connector according to claim 1, wherein the connecting member includes a fastening plate section formed into a flat plate shape, and a supporting plate section which is raised from an end section of the fastening plate section, wherein the housing includes a bottom wall, and a hood section extending away from the bottom wall, the hood section and the bottom wall form a fitting concave section that is configured to receive the counterpart connector therein, and wherein the tab sections are connected to the supporting plate section, and the tab sections extend from the bottom wall and into the fitting concave section, wherein a holding section of the supporting plate section includes an exposed surface that is exposed through the bottom wall to the fitting concave portion, and the exposed surface is configured to be gripped by a mold.

5. The connector according to claim 4, wherein the holding section includes an outer surface that is outside of the exterior of the housing, and the outer surface is configured to be gripped by a mold.

6. The connector according to claim 4, wherein the holding section includes an outer surface that is located between the housing bottom wall and the fastening plate section, and the outer surface is configured to be gripped by a mold.

* * * * *